US006945680B2

(12) United States Patent
Holzmann et al.

(10) Patent No.: US 6,945,680 B2
(45) Date of Patent: Sep. 20, 2005

(54) LIGHT ASSEMBLY

(75) Inventors: Hans-Peter Holzmann, Simpsonville, SC (US); Marek Djordjevic, Los Angeles, CA (US)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 107 days.

(21) Appl. No.: 10/608,446

(22) Filed: Jun. 30, 2003

(65) Prior Publication Data

US 2004/0062052 A1 Apr. 1, 2004

Related U.S. Application Data

(60) Provisional application No. 60/391,921, filed on Jun. 28, 2002.

(30) Foreign Application Priority Data

Jun. 29, 2002 (DE) ..... 102 30 277

(51) Int. Cl.[7] ..... F21V 1/00

(52) U.S. Cl. ..... 362/509; 362/521; 362/307; 362/310

(58) Field of Search ..... 362/509, 521, 362/538, 539, 307, 310, 522

(56) References Cited

U.S. PATENT DOCUMENTS 5,373,423 A * 12/1994 Liedtke et al. ..... 362/521
5,964,525 A * 10/1999 Albou ..... 362/522

FOREIGN PATENT DOCUMENTS

DE 3148668 A1 * 7/1983

* cited by examiner

*Primary Examiner*—Stephen F Husar
(74) *Attorney, Agent, or Firm*—Crowell & Moring LLP

(57) ABSTRACT

A light assembly, particularly for a motor vehicle, essentially consists of a housing covered by a clear, optically inactive covering pane in which at least one light unit is arranged which is formed of a light with a pertaining reflector. A screen, which is constructed as a semireflecting mirror, is arranged between the covering pane and the light unit. The screen separates a rearward light unit space accommodating the light unit from a forward light unit space formed by the screen and the covering pane, so that the rearward light unit space cannot be seen on the inside by a viewer looking in the direction of the light unit. The screen is transparent for the light emitted by the light when the light is switched on.

24 Claims, 1 Drawing Sheet

LIGHT ASSEMBLY

BACKGROUND AND SUMMARY OF THE INVENTION

The invention relates to a light assembly, particularly for a motor vehicle, essentially consisting of a housing covered by a clear, optically inactive covering pane, in which at least one light unit is arranged. The light unit is formed of a light with a pertaining reflector.

Lighting systems of motor vehicles, particularly front lighting combinations, increasingly have clear covering panes without any optical function. The generated light distribution of the light units situated behind the covering pane is implemented by a corresponding construction of the reflectors and of the pertaining lights. For this purpose, a certain depth, surface structure and symmetry or asymmetry of the componentry to be used are required. The reflectors are usually adjustable, for example, in order to permit a vertical light aim control adapted to the respective loading of the vehicle. The light sources or lights, such as bulb-type lights or gas discharge lights, may be covered by additional caps. In addition to the constructively advantageous implementation of diverse adjusting possibilities by placing the optically active components in the interior of the light unit, the clear covering panes are now also demanded because of design definitions. Because, as a result of the clear covering pane, the details of the lights and reflectors, which sometimes have a high-expenditure design, are visible in an unhindered manner, when the lighting is not switched on, the technical impression is in the forefront for a viewer of such a front light. In addition, a relatively large reflector depth gives a very large appearance to the highlight or the light unit.

Based on the definitions of the vehicle design, the overall visual impression of a light assembly should also be taken into account as a marginal condition, in addition to defined sizes and shapes, because the light assembly should harmonically fit into a given vehicle body.

Particularly in the case of more expensive vehicles, which endeavor to make a discreet impression, a stressing of the technical details of a light as a result of an unhindered view through the clear covering pane and the impression of a very large light assembly because of a relatively large reflector depth may be considered as spoiling the appearance. In addition, certain reflector shapes and reflector surfaces, which would ensure an optimal homogeneous light distribution and a high light-related efficiency, can often not be used to an unlimited extent because they do not correspond to the design definitions and could have a visually disadvantageous effect on the viewer.

From U.S. Patent Document U.S. Pat. No. 5,010,458, a front light arrangement is known which is covered by a clear lens. Various reflector parts in the interior of the arrangement may have certain tinted coatings coordinated with the vehicle paint. As a result, the covering lens appears to the viewer in the color of the surrounding vehicle body. In particular, a reflector housing and a light casing may be coated in the color of the adjoining vehicle body parts. The reflector itself may also be color-coated. In this case, a colored, semireflecting metal layer is vapor-deposited upon the reflector surface which, on the one hand, causes the reflector to appear in color and, on the other hand, radiates the light reflected from a basic coating situated underneath when the lighting is switched on toward the outside without any change of color.

The known arrangement has the disadvantageous effect that, despite the appearance of the light, which is color-coordinated with the surrounding vehicle body, when the lighting is not switched on, the technical details of the construction are visible at least at close range. This applies particularly when the reflector is covered by a clear covering pane instead of a lens. In the case of front lighting combinations which have differently tinted lights, such as yellow direction indicator lights, in addition, the appearance will not be uniform.

It is therefore an object of the invention to improve the known light assemblies with clear covering panes such that, irrespective of a reflector and light design optimized with respect to the light distribution, they make a discreet and visually high-quality impression on a viewer and fit harmonically into the surrounding design of a vehicle. A technically required reflector or light design should have as little influence as possible on the overall appearance of the light assembly.

According to the invention, this object is achieved in a light assembly, particularly for a motor vehicle, essentially consisting of a housing covered by a clear, optically inactive covering pane, in which at least one light is arranged which is formed of a light with a pertaining reflector. A screen, which is constructed as a semireflecting mirror, is arranged between the covering pane and the light unit, which screen separates a rearward light unit space receiving the light unit from a forward light unit space formed by the screen and the covering pane, so that the rearward light unit space cannot be seen on the inside by a viewer looking in the direction of the light unit and the screen is transparent for the light emitted by the light when the lighting is switched on.

As a result of the fact that the screen is arranged between the clear covering pane and the reflector with the light, the technical details, that is, the reflector and the bulb-type light, or, in the case of light combinations, the reflectors and the bulb-type lights, are not visible. As a semireflecting mirror, the screen carries out the function of protecting against seeking into the rearward light unit space. In contrast, the light emitted by the light or lights can pass unchanged, or at least almost unchanged, through the mirror. As a result of the reflecting surface and the relatively flat forward light unit space defined by the screen, the entire light assembly receives a very "flat" design, which visually is felt to be advantageous. Since the reflectors and the light units are not visible, they can be implemented with respect to their shape and surface for an optimal light distribution without taking into account the visual impression made by them. As a result, the technically achievable efficiency of the head-light assembly can be better utilized. This permits a particularly homogeneous illumination. Also, tinted bulb-type lights, such as yellow direction indicator lights, cannot spoil the effect. On the whole, the light assembly makes a high-quality discreet visual impression while simultaneously being compatible with the use of light unit components of the highest light-related efficiency.

According to a preferred embodiment of the invention, the screen consists of a base plate which, on a front side facing the covering pane, has a semireflecting metal coating applied by means of a vapor-depositing process.

As a result of a vapor-deposited metal layer, a semireflecting mirror can be produced in a simple and cost-effective manner. The thickness of the metal layer is preferably within the wavelength range of the visible light so that it meets the requirements of the semireflecting mirror with respect to: (a) preventing one from being able to see into the reflecting front side, and (b) the transmissibility of the light emitted by the light assembly when the illumination is switched on. In principle, a suitable dielectric coating of the base plate of the screen consisting of one or several layers is also conceivable for implementing the semireflecting mirror.

According to another preferred embodiment of the invention, the base plate consists of a clear plastic material.

The plate made of the clear plastic material can be produced in a simple and cost-effective manner in the desired shape. It has a low weight and can easily be arranged and held in the light assembly. The clear plastic ensures that the light of the bulb-type lights or the gas discharge lights of the light unit or units can pass through the base plate at least almost unchanged.

According to another preferred embodiment of the invention, the screen has a contour adapted to the light units.

The contouring of the screen preferably traces the outline of the reflector shape. In the case of several reflectors in the light assembly, the same applies to the additional reflectors. This gives the impression of a light but without overly stressing the technical details. As a result, the impression is discreet but not too abstract or unrealistic, whereby the overall appearance of the light assembly is further improved.

According to another preferred embodiment of the invention, the screen is held in a receiving device in an edge of the housing and/or in a receiving device in an edge of the covering pane, and closes off flush and tightly with the housing edge and the covering pane edge.

The holding of the screen in a receiving device of the edges of the housing and of the covering permits a particularly secure fixing of the components when assembling the light assembly. For example, one surrounding groove respectively may be provided in the edges of the housing and the covering pane, into which groove a projection of the screen engages, which extends around on both sides. For the sealing, sealing rings may additionally be provided which extend on both sides around the projections. A firm and tight connection of the components can be implemented by a snap-in locking which, when joined, locks the components with one another and closes them off tightly. The connection or the locking can be designed, for example, to be releasable again for exchanging a defective covering pane. This has an advantageous effect on possibly occurring servicing and repair costs.

According to another preferred embodiment of the invention, the screen is firmly connected with the edges of the housing and of the covering pane by means of gluing.

By gluing together the components at the edges, the screen can be mounted in a simple and particularly cost-effective manner.

According to another preferred embodiment of the invention, the screen is fastened on an interior side of the housing.

Instead of in the area of the surrounding edges of the housing and the covering pane, the screen may also be fastened in a simple manner on the interior side, that is, on the interior wall of the housing. As a result, no constructive change of the connection of the housing and the covering is required when the screen is inserted in previous light assemblies, which saves production costs.

According to another preferred embodiment of the invention, the screen is fastened to an interior side of the covering pane.

By fastening the screen to the interior side of the covering pane, as it were, a one-piece component is created, which has a favorable effect on the assembly cost.

According to a preferred embodiment of the invention, measures for compensating thermally caused tensions of the material are provided on at least one connection section between the screen and the housing and/or the covering pane.

The measures for avoiding tensions of the material between the housing, screen and covering components prevent the risk of the formation of cracks as a result of different thermal expansions of the components during the operation of the light unit and as a result of exterior effects, such as frost or direct sun radiation. This increases the service life of the light assembly. The measures may be provided on one or several connection sections, such as expansion joints or recesses.

For example, by means of a ventilation at the rear, or other measures for carrying off heat generated in the rearward light unit space, a sufficient thermal relief can be provided.

According to another preferred embodiment of the invention, the design of the lights and of the reflectors can be adapted to an interaction of the light emitted by the lights with the screen, for generating a respectively defined light distribution.

As a result of the fact that the light and the reflector, that is, the components of the light unit, can be adapted to an interaction of the light emitted by them with the screen, a light distribution, which is subject to particularly strict requirements can be maintained in a precise manner. In exceptional cases of special combinations of wavelengths of the emitted light, screen material and coating in which a slight light scatter, light refraction or light absorption cannot be excluded and a light distribution to be maintained according to precise data would possibly be impaired, the components of the light unit or units can correspondingly be adapted constructively or by a suitable selection of the components. Since it is impossible to look into the rearward light unit space, this can take place without impairing the visually high-quality appearance of the light assembly which is to be achieved. By adapting the light units, if required, an influence of the screen on the light distribution can be compensated.

BRIEF DESCRIPTION OF THE DRAWING

Additional details of the invention are contained in the following detailed description and the attached drawing in which a preferred embodiment of the invention is illustrated as an example.

DETAILED DESCRIPTION OF THE DRAWING

Figure 1:
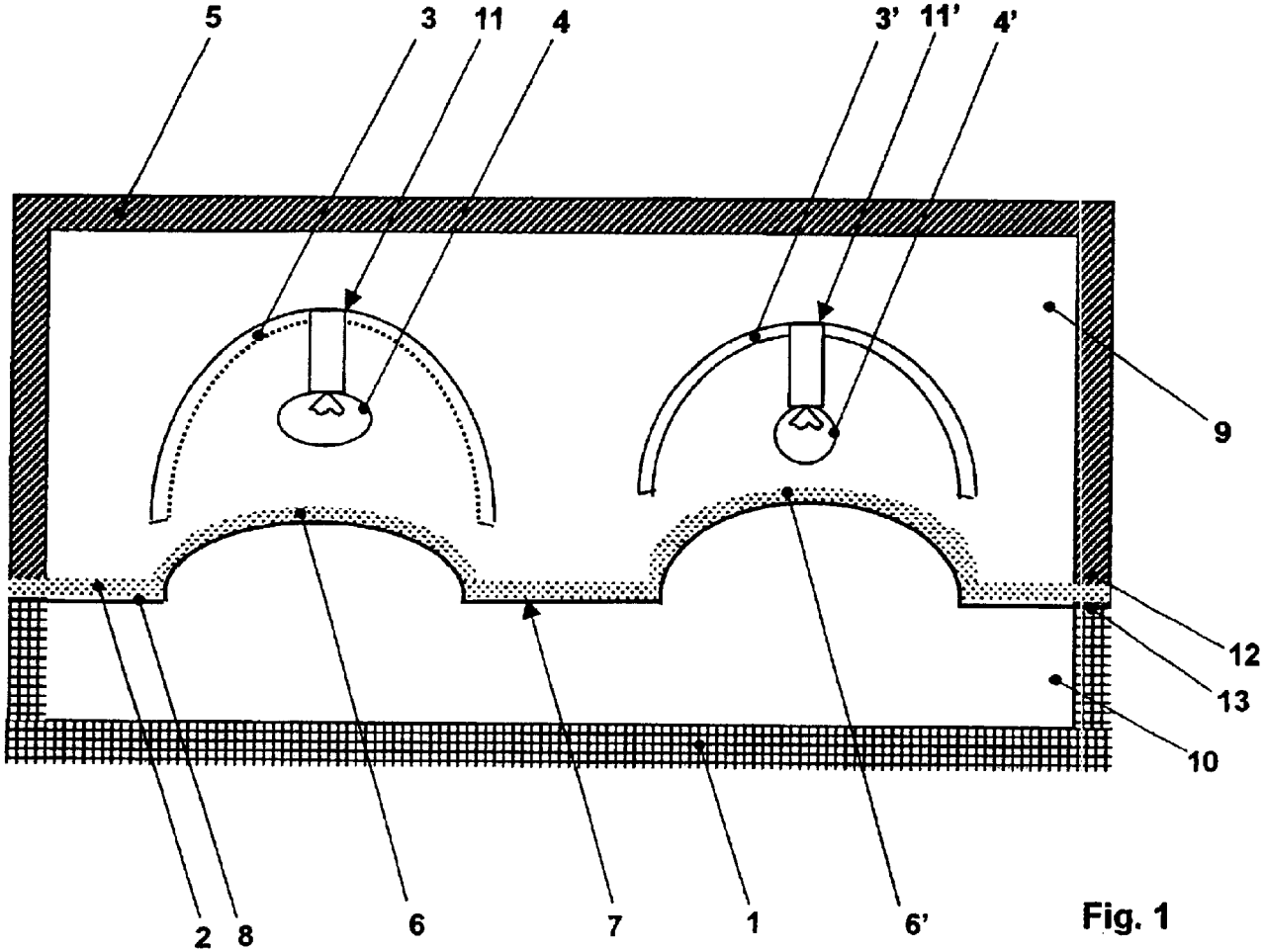
FIG. 1 is a sectional top view of a light assembly.

A light assembly consists essentially of a housing 5, having a light unit 11, a screen 7 and a covering pane 1.

The embodiment in FIG. 1 shows a front light unit combination of a first light unit 11 with a second light unit 11'. The light unit 11 may be constructed, for example, as a position and daylight driving light unit, and the light unit 11' may be constructed as a direction indicator light unit. The light units 11, 11' are constructed of a bulb-type light 4 and 4', respectively, and an assigned reflector 3 and 3', respectively, and are fastened in a known manner in the housing 5 and connected to a voltage supply and a switching system of the vehicle. The housing 5 is covered with a clear covering pane 1, which is advantageously constructed as a contoured glass pane adapted to the shape of the head light and of the surrounding vehicle body. For simplifying the representation, FIG. 1 only shows a rectangular shape. The housing 5 and the covering pane 1 have surrounding edges 12 and 13 respectively, between which the screen 7 is arranged, for example, in (not shown) recesses or receiving devices. On the one side, the screen 7 is connected with the housing 5 and, on the other side, with the covering pane 1, for example, by means of a (not shown) snap-in locking device so that, in the area of the connections, the light assembly is closed off tightly toward the outside. As an alternative, the connections may also be simple glued connections. By means of the screen 7, a rearward light unit space 9 is separated from a forward light unit space 10. The rearward light unit space 9 accommodates the light units 11, 11' and is formed by the housing 5 and the screen 7. The forward light unit space 10 is formed by the screen 7 and the covering pane 1. The screen 7 itself consists of a base plate 2, preferably made of a clear plastic material, and a semi-reflecting thin metal layer 8, preferably a silver layer, vapor-deposited on a front side facing the covering pane 1, that is, vapor-deposited on one side. As a result, a semireflecting mirror is formed. When the lighting is switched off, a viewer will see the screen 7 as a mirror. The viewer cannot look into the rearward light unit space 9. In contrast, when the lighting is switched on, the light emitted by the lights 4 and 4' respectively can radiate unhindered through the screen 7 to the outside with the light distribution generated by the reflectors 3 and 3', respectively.

Two contourings 6 and 6', respectively, are formed in the screen 7. The contours 6, 6' trace the shape of the pertaining reflector 3 and 3', respectively, in the manner of an outline. As a result, the viewer seems to look into a flat head light with outlined reflectors but without any technical details, whereby the desired discreet and visually high-quality impression of the light assembly is provided.

Table of Reference Numbers

| | |
|---|---|
| 1 | Covering pane |
| 2 | base plate |
| 3, 3' | reflector |
| 4, 4' | light |
| 5 | housing |
| 6, 6' | contour |
| 7 | screen |
| 8 | coating |
| 9 | rearward light unit space |
| 10 | forward light unit space |
| 11, 11' | light unit |
| 12 | housing edge |
| 13 | covering pane edge |

What is claimed is:

1. A light assembly for a motor vehicle, comprising:

a housing in which a least one light unit is arranged, the light unit including a light and a pertaining reflector;

a covering pane covering the housing;

a semireflecting mirror screen having a uniformly semi-reflecting surface, the screen being arranged between the covering pane and the light unit; and wherein the screen separates a rearward light unit space accommodating the light unit from a forward light unit space formed by the screen and the covering pane such that an interior of the rearward light unit space cannot be seen by a viewer looking in he direction of the light unit, and further wherein the screen is transparent for a light emitted by the light unit when switched on.

2. The light assembly according to claim 1, wherein the screen comprises a base plate which, on a front side facing the covering pane, has a vapor-deposited semireflecting metal coating.

3. The light assembly according to claim 2, wherein the base plate is formed of a clear plastic material.

4. The light assembly according to claim 1, wherein the screen has a contour adapted to the at least one light unit.

5. The light assembly according to claim 2, wherein the screen has a contour adapted to the at least one light unit.

6. The light assembly according to claim 3, wherein the screen has a contour adapted to the at least one light unit.

7. The light assembly according to claim 1, wherein the screen is held in a receiving device formed in an edge of at least one of the housing and the covering pane, said screen being closed-off flush and tightly with the respective edge of the housing and the covering pane.

8. The light assembly according to claim 2, wherein the screen is held in a receiving device formed in an edge of at least one of the housing and the covering pane, said screen being closed-off flush and tightly with the respective edge of the housing and the covering pane.

9. The light assembly according to claim 3, wherein the screen is held in a receiving device formed in an edge of at least one of the housing and the covering pane, said screen being closed-off flush and tightly with the respective edge of the housing and the covering pane.

10. The light assembly according to claim 4, wherein the screen is held in a receiving device formed in an edge of at least one of the housing and the covering pane, said screen being closed-off flush and tightly with the respective edge of the housing and the covering pane.

11. The light assembly according to claim 1, wherein the screen is firmly connected by glue with edges of the housing and the covering pane.

12. The light assembly according to claim 2, wherein the screen is firmly connected by glue with edges of the housing and the covering pane.

13. The light assembly according to claim 3, wherein the screen is firmly connected b glue with edges of the housing and the covering pane.

14. The light assembly according to claim 4 wherein the screen is firmly connected by glue with edges of the housing and the covering pane.

15. The light assembly according to claim 1, wherein the screen is fastened to an interior side of the housing.

16. The light assembly according to claim 2, wherein the screen is fastened to an interior side of the housing.

17. The light assembly according to claim 3, wherein the screen is fastened to an interior side of the housing.

18. The light assembly according to claim 4, wherein the screen is fastened to an interior side of the housing.

19. The light assembly according to claim 1, wherein the screen is fastened to an interior side of the covering pane.

20. The light assembly according to claim 2, wherein the screen is fastened to an interior side of the covering pane.

21. The light assembly according to claim 3, wherein the screen is fastened to an interior side of the covering pane.

22. The light assembly according to claim 4, wherein the screen is fastened to an interior side of the covering pane.

23. The light assembly according to claim 1, further comprising means for compensating thermally caused tensions of the light assembly materials, said compensating means being provided on at least one connection section between the screen, the housing, and/or the covering pane.

24. The light assembly according to claim 1, wherein the at least one light and pertaining reflector for generating a defined light distribution are adaptively designed to account for an interaction of light emitted by the light with the screen.

* * * * *